US005709700A

United States Patent [19]

Hirota

[11] Patent Number: 5,709,700

[45] Date of Patent: Jan. 20, 1998

[54] HOLE MAKING DEVICE

[75] Inventor: Masaho Hirota, Tokyo, Japan

[73] Assignees: Kato Spring Works Co., Ltd, Tokyo; K & T Corporation, Ohmiya, both of Japan

[21] Appl. No.: 630,278

[22] Filed: Apr. 11, 1996

[30] Foreign Application Priority Data

Aug. 30, 1995 [JP] Japan ..... 7-222376

[51] Int. Cl.[6] ..... A61B 17/34

[52] U.S. Cl. ..... 606/188; 606/181

[58] Field of Search ..... 606/188, 181, 606/185

[56] References Cited

U.S. PATENT DOCUMENTS

| | | | |
|---|---|---|---|
| 3,831,597 | 8/1974 | Shiller . | |
| 4,030,507 | 6/1977 | Mann | 128/330 |
| 4,286,600 | 9/1981 | Judickas | 606/188 |
| 4,860,747 | 8/1989 | Sciara | 606/188 |
| 5,004,470 | 4/1991 | Mann | 606/188 |

FOREIGN PATENT DOCUMENTS

| | | |
|---|---|---|
| 1119498 | 3/1982 | Canada . |
| 1309709 | 3/1973 | United Kingdom . |
| 2272377 | 5/1994 | United Kingdom . |

*Primary Examiner*—Michael Buiz
*Assistant Examiner*—Kevin Truong
*Attorney, Agent, or Firm*—Cushman, Darby & Cushman IP Group of Pillsbury, Madison & Sutro LLP

[57] ABSTRACT

The present invention relates to a hole making device which comprises a hole maintenance member having a rod portion, a needle member having a sharp tip and a recess for accommodating the rod portion of the hole maintenance member, a piercing mechanism for sticking the needle member accommodating the rod portion of the hole maintenance member through an object in which a hole is to be made, an extraction mechanism for receiving the needle member penetrating the object, and extracting the needle member through the object toward a direction to which the sharp tip of the needle member points so as to leave the hole maintenance member in the object, and an interlock mechanism for interlocking the piercing mechanism and the extraction mechanism.

14 Claims, 17 Drawing Sheets

FIG.20
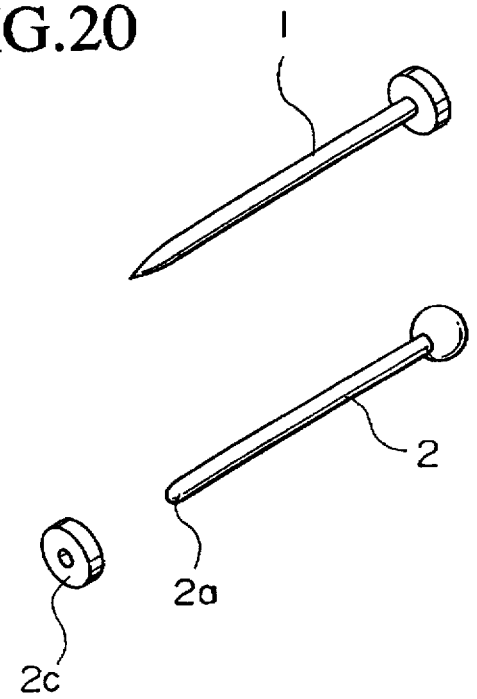
FIG. 21(A)
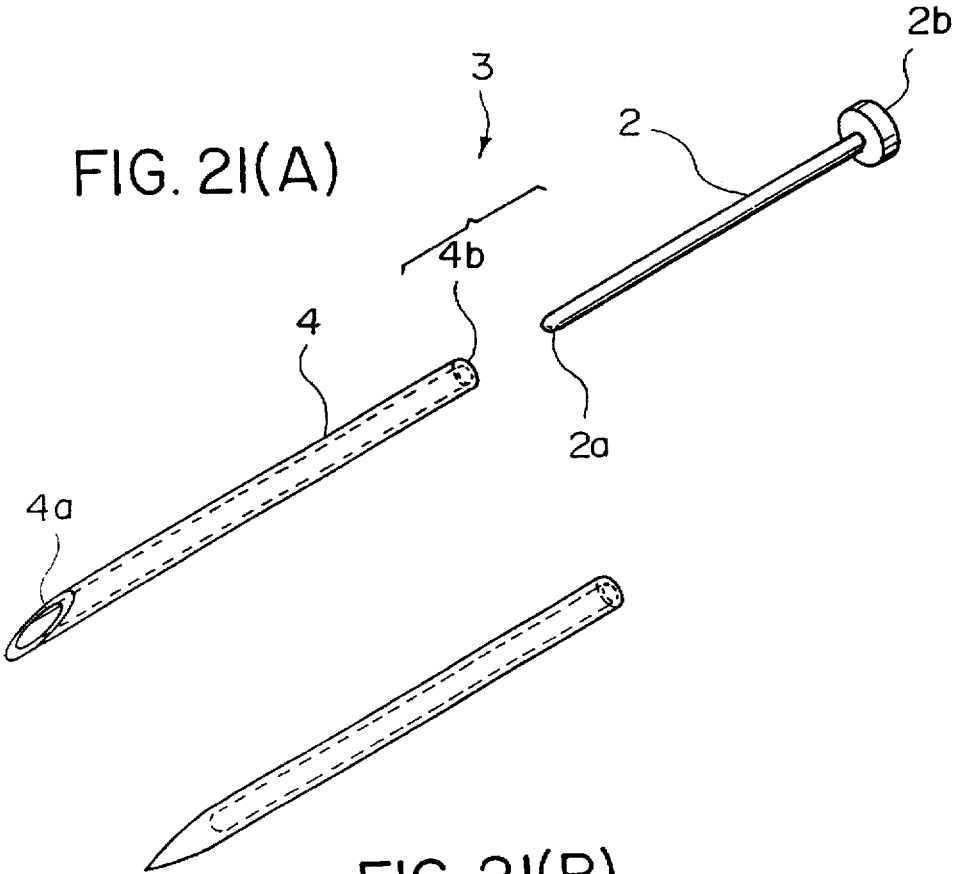
FIG. 21(B)

HOLE MAKING DEVICE

BACKGROUND OF THE INVENTION

The present invention relates to a device for making a hole in the earlobe or the like for the purpose of attaching a pierced earring thereto.

Pierced earrings, which are worn by making a small hole in the earlobe or other part of the body, and inserting a post through the pierced hole, enjoy great popularity. The procedure for making a small hole in the earlobe or the like is normally carried out, first, by piercing the earlobe by a simple surgical operation, and next, by inserting a hole maintenance rode, which has a similar shape to a pierced earring, into the hole, and further, by leaving the maintenance rod in for place several weeks to allow healing of the internal wound in the hole and to allow formation of the small hole. This is because if the pierced earring is left out of the pierced hole shortly after the piercing is performed, the hole will close up immediately.

In the conventional piercing operation, as shown in FIG. 20, after the earlobe is pierced with a needle 1, a rod portion of a hole maintenance rod 2 is inserted into the pierced hole, and a fastener 2*c* is fixed to the rod portion so as to prevent the rod 2 from falling out of the hole. However, since this prior operation requires piercing twice with the needle 1 and the maintenance rod 2, the person undergoing this operation must experience pain twice. In particular, because the pierced hole will gradually decrease in size after pulling out the needle 1 from the hole, insertion of the round tip of the maintenance rod 2 into the reduced hole sometimes causes bleeding and severe pain.

In order to prevent the bleeding and experiencing pain twice, a hole making tool 3 shown in FIG 21 was disclosd in Japanese Utility Model, First Publication, No. Hei 1-74815 and the like. This hole making tool 3 consists of a slender tube 4 having sharp tip 4*a* and an opening 4*b* respectively at the opposite ends, and a hole maintenance rod 2 having a round tip 2*a* and a flange 2*b*, respectively, at the opposite ends. The hole making process with this tool 3 is performed as follows. First, with the hole maintenance rod 2 inserted into the tube 4, the tube 4 receiving the rod 2 is stuck perpendicularly through the earlobe until the flange 2*b* contacts the earlobe. Next, only the tube 4 is pulled out toward the direction of the sharp tip 4*a*, and thus; the hole maintenance rod 2 is left in the pierced hole.

According to this hole making tool 3, it is possible to simultaneously perform the piercing and the insertion of the hole maintenance rod 2; therefore, the pain and the bleeding raised by the insertion of the rod 2 can be prevented.

However, even in the case Where the above hole making tool 3 is used, the first piercing of the earlobe must be accomplished by the operator. Therefore, if the operator fails to smoothly carry out the piercing and the removal of the tube 4, the person undergoing this operation experiences excessive pain; therefore, this operation requires skill on the part of the operator.

SUMMARY OF THE INVENTION

It is an object of the present invention to provide a hole making device with which it is possible to make a hole in the earlobe or the like in a quick and simple manner without requiring the skill of an expert.

In order to accomplish the above object, the hole making device of the present invention comprises:

a hole maintenance member having a rod portion;

a needle member having a sharp tip and a recess for accommodating the rod portion of the hole maintenance member;

a piercing mechanism for sticking the needle member accommodating the rod portion of the hole maintenance member through an object in which a hole is to be made;

an extraction mechanism for receiving the needle member penetrating the object, and extracting the needle member through the object toward a direction to which the sharp tip of the needle member points so as to leave the hole maintenance member in the object; and an interlock mechanism for interlocking the piercing mechanism and the extraction mechanism.

According to the hole making device of the present invention, it is possible to achieve both the piercing of the earlobe and the extracting of the needle member in a smooth and continuous manner. Thus, it is possible to shorten the time which is necessary for the operation and reduce the pain of the person undergoing the operation, without requiring the skill of an operator.

The hole making device according to another aspect of the present invention further comprises:

a body for accommodating the piercing mechanism, the extraction mechanism, and the interlocking mechanism;

a cartridge for detachably supporting the needle member in which the hole maintenance member is inserted; and a cartridge mounting provided on the body for detachably mounting the cartridge so that the sharp tip of the needle member supported by the cartridge is directed toward the extraction mechanism and so that the opposite end to the sharp tip is directed toward the piercing mechanism.

According to this device, because the detachable cartridge is employed for loading the needle member and the hole maintenance rod at the initial position, it is easy to safely handle the needle member and the rod, which are too small to be easily handled.

In the hole making device according to another aspect of the present invention, the piercing mechanism comprises a needle pusher being movable along an axis of the needle member, and the interlock mechanism comprises a bias means for biasing the needle pusher in a direction opposite to a direction in which the needle member is pushed. According to this device, the needle pusher is automatically pushed back to the initial position by the bias means after the piercing of a hole, and it is thereby possible to simplify the operation of the piercing mechanism.

In the hole making device according to another aspect of the present invention, the extraction mechanism comprises a grasp mechanism for grasping the sharp tip of the needle member when the sharp tip of the needle member is inserted thereinto. In this case, the reliability of the grasp movement can be improved, and further, simplifying the grasp mechanism is possible.

In the hole making device according to another aspect of the present invention, the interlock mechanism comprises a first rack for shifting the piercing mechanism, a second rack arranged in parallel with the first rack for shifting the extraction mechanism, and a pinion engaging with both the first and second racks. According to this device, it is easy to completely synchronize the movements of the piercing mechanism and the extraction mechanism, while simplifying the structure of the interlock mechanism.

In the hole making device according to another aspect of the present invention, the shifting mechanism comprises a bias means for urging the grasp mechanism in a direction towards which the needle member is extracted, a stopper for locking the grasp mechanism at a position in which the grasp mechanism is shifted towards the needle member against the force generated by the bias means, and an unlock mechanism connected to the piercing mechanism for unlocking the stopper when the piercing mechanism inserts the needle member into the object.

In this case, as soon as the operator has finished the piercing operation, the interlock mechanism automatically shifts the grasp mechanism to extract the needle member from the earlobe, regardless of the situation of the piercing mechanism. Therefore, it is possible to perform both the piercing and the extraction of the needle member in a smoother and more continuous manner. The interlock mechanism may comprise a biasing means for urging both the needle pusher and the grasp mechanism in opposite directions to each other.

In the hole making device according to another aspect of the present invention, the extraction mechanism comprises a grasp mechanism for grasping the sharp tip of the needle member, a support supporting the grasp mechanism rotatably around an axis perpendicular to an axis of the needle member, a shifting mechanism for shifting the support between a first position in which the grasp mechanism is located close to the piercing mechanism and a second position in which the grasp mechanism is located apart from the piercing mechanism, and a pivoting mechanism for pivoting the support so that the grasp mechanism faces towards the needle member when the support is shifted to the first position, and so that the grasp mechanism faces towards a direction intersecting with the direction of shifting the support when the support is shifted to the second position.

According to this device, when the extraction of the needle member is finished, the grasp mechanism and the needle member are turned towards a different direction, for example, upward. This pivotal movement of the grasp mechanism can facilitate picking up the used needle member in a safe and sanitary manner.

In the hole making device according to another aspect of the present invention, the grasp mechanism comprises a pair of pivoting cams for grasping the sharp tip of the needle member between ends thereof, and a bias means for urging the ends of the cams towards each other. In this case, by leverage of the pivoted cams, it is possible to firmly grasp the needle member with a strong force, thereby improving the reliability of the grasp mechanism. Furthermore, simplifying the grasp mechanism is possible.

In the another aspect of the present invention, the cartridge has a loading hole for detachably loading the needle member accommodating the rod portion of the hole maintenance member, and a guide detachably attached on the needle member for supporting the needle member in the loading hole. The guide may comprise a pair of gutter-shaped parts which are separatably assembled to form a cylindrical shape. In this case, because the needle member is coaxially supported by the cylindrical needle guide in the loading hole of the cartridge, it is possible to accurately position the needle member. Therefore, the needle pusher pushes the needle member accurately along the axis of the needle pusher, and deviations in the penetrating direction of the needle member can be prevented. The gutter-shaped parts preferably have engaging means for engaging with each other, for the purpose of improving the ease of handling of the needle guide.

BRIEF DESCRIPTION OF THE DRAWINGS

FIG. 20 is a perspective view of a hole making tool of the prior art.

FIG. 21 is a perspective view of other hole making tool of the prior art.

DETAILED DESCRIPTION OF THE PREFERRED EMBODIMENTS

First Embodiment

Referring to FIGS. 1 to 8, the best mode of the hole making device, according to the first embodiment of the present invention, will be explained.

Figure 1:
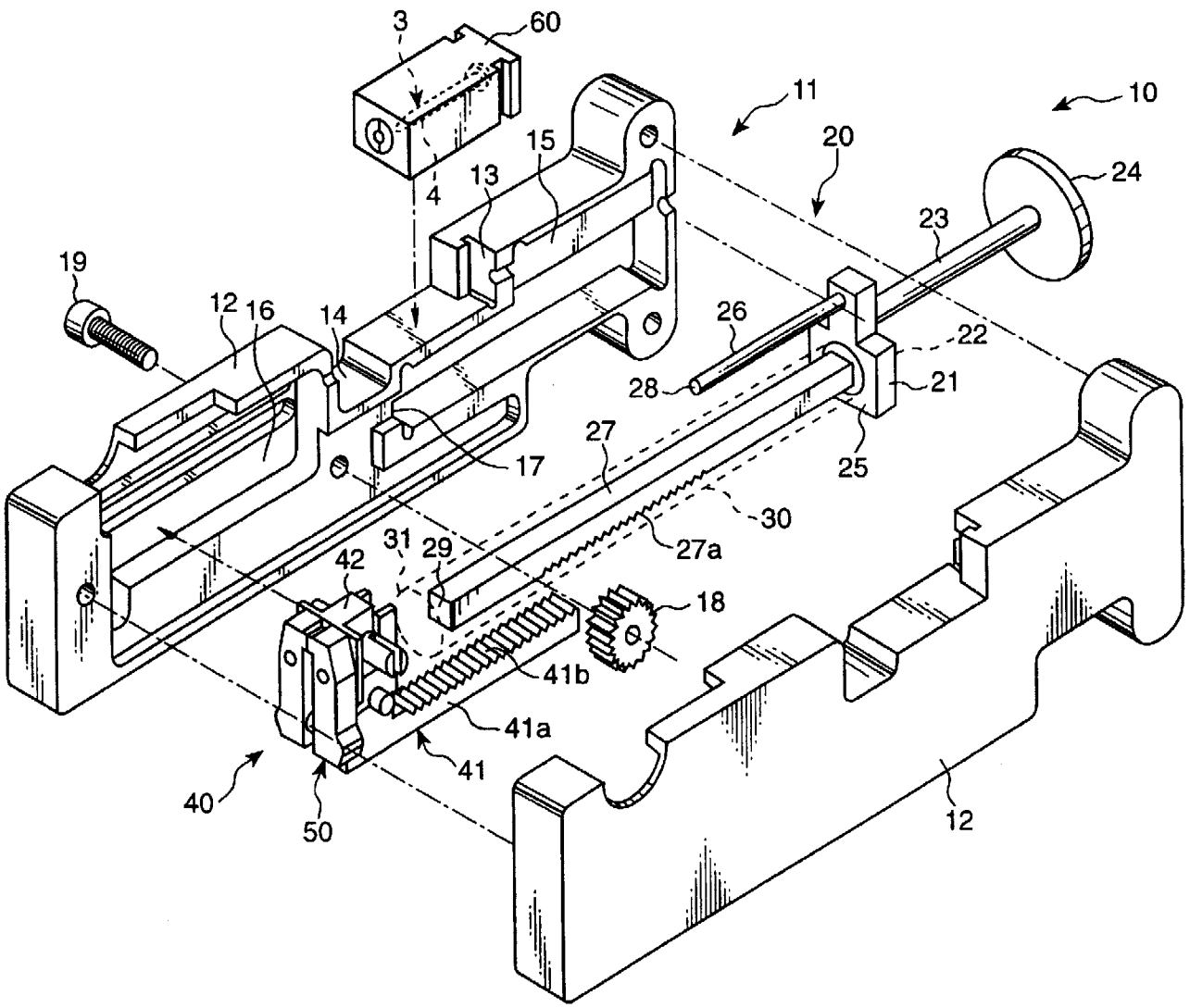
FIG. 1 is an exploded view of a hole making device according to the first embodiment of the present invention.

As shown in FIG. 1, this hole making device 10 comprises a piercing mechanism 20 for inserting a hole making tool 3 through an object, for example an earlobe, in which a hole is to be made, an extraction mechanism 40 for receiving the needle member 4 penetrating the earlobe and extracting the needle member 4 through the earlobe, and an interlock mechanism 18, 27, 30, and 41 for interlocking the piercing mechanism 20 and the extraction mechanism 40. The hole making tool 3 consists of a needle member 4 and a hole maintenance rod 2, which are substantially identical with conventional ones shown in FIG. 21. However, the tool 3 is not limited to that shown in FIG. 21; it may be modified according to the object in which a hole is to be made.

Figure 3:
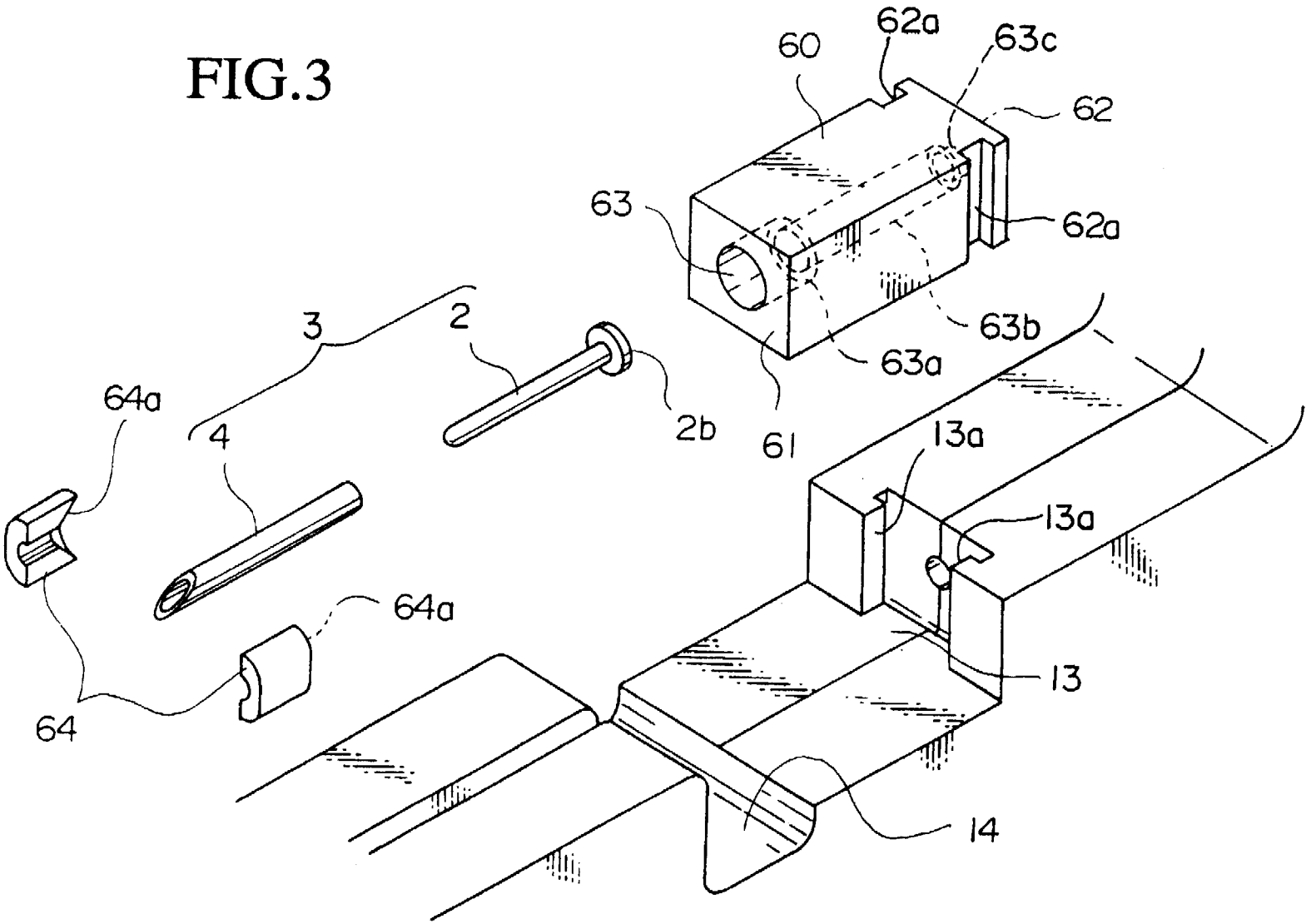
FIG. 3 is a perspective view of a mount structure of a cartridge of the first embodiment.

As shown in FIG. 1, the piercing mechanism 20, the extraction mechanism 40, and the interlock mechanism 18, 27, 30, and 41 are all accommodated in a body 11 having a substantially rectangular shape. The body 11 is constructed by a pair of casings 12 in a separatable manner, and a cartridge mounting 13 and an earlobe insertion recess 14 are formed adjacent to each other in the middle of the upper side of the body 11. As shown in FIG. 3, a rectangular cartridge 60 for loading the hole making tool 3 is detachably mounted in the cartridge mounting 13.

Figure 4:
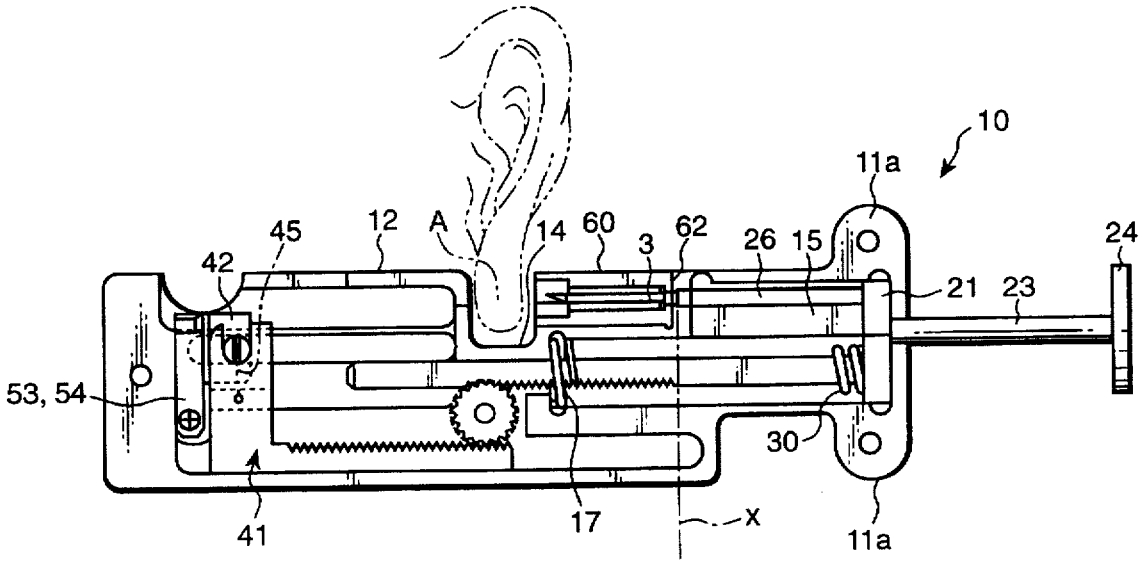
FIGS. 4–8 are respectively cross sections of the first embodiment explaining the action of the device during the hole making operation.

The piercing mechanism 20 comprises a slide plate 21 which is provided, in a space 15 formed in the body 11, in a slidable manner in a longitudinal direction of the body 11. A rod 23 extended rearward is fixed to rear face 22 of the plate 21 so as to protrude outside of the body 11, and a circular handle 24 is fixed perpendicularly to the protruding end of the rod 23. On the other face 25 of the plate 21, a needle pusher 26 having a rod shape and a first rack 27 are respectively fixed in a parallel manner with the rod 23, and the needle pusher 26 is constructed to protrude its tip 28 outside of the body 11 through the cartridge mounting 13 when the handle 24 is pushed forward, thereby pushing the needle member 4 out of the cartridge 60 towards the earlobe insertion recess 14. In the body 11, a space 16 is formed to permit sliding of the tip 29 of the rack 27. A bias means, for example a coil spring 30 in this embodiment, is passed along the rack 27, and the coil spring 30 is compressed between a front wall 17 of the space 15 and the plate 21, as shown in FIG. 4. The spring 30 biases the plate 21 rearward so that the needle pusher 26 is dram back from the cartridge mounting 13.

Figure 2:
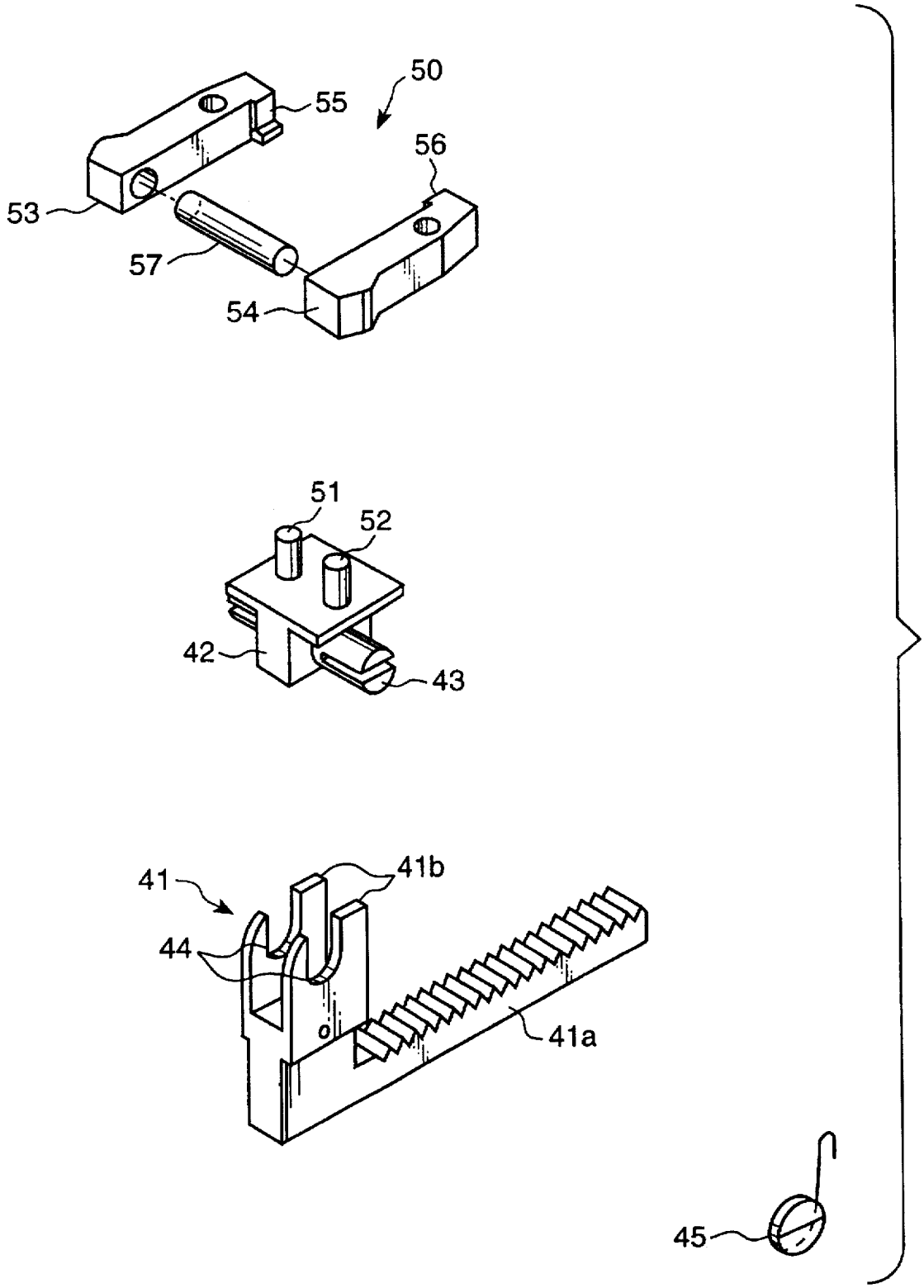
FIG. 2 is a perspective view of a grasp mechanism and an interlock mechanism of the first embodiment.

The extraction mechanism 40 comprises a gasp mechanism 50 for gasping the sharp tip of the needle member 4 when the sharp tip of the needle member 4 is inserted therein, and a support 42 for supporting the grasp mechanism 50. As shown in FIG. 2, the support 42 is attached to a front end of a second rack 41, which is a part of the interlock mechanism, and the second rack 41 is slidably accommodated in the space 16 in a manner parallel to the first rack 27. Between the first and second racks 27 and 41, a pinion 18 is provided to engage both the rack gear 27*a* and 41*b* of the first and second racks 27 and 41; the needle pusher 26 and the gasp mechanism 50 are thereby constructed so as to approach each other by pushing the handle 24. The pinion 18 is rotatably supported by a bolt 19 fixed in the body 11.

The second rack 41 comprises a horizontal rack portion 41*a* and a pair of bearing plates 41*b* which protrude upright from the front end of the rack portion 41 a in a manner parallel with each other. The bearing plates 41*b* respectively have recesses 44 for rotatably receiving protrusions 43 formed on both sides of the support 42; the support 42 can thereby rotate, from a first position in which the upper surface of the support 42 becomes vertical (see FIG. 1), to a second position in which the upper surface of the support 42 becomes horizontal (see FIG. 6). A spring 45 is attached between one of the protrusions 43 and the second rack 41, and this spring 45 urges the support 42 to incline to the first position so as to keep the gasp mechanism 50 apart from the needle member 4 as shown FIG. 1.

Figure 5:
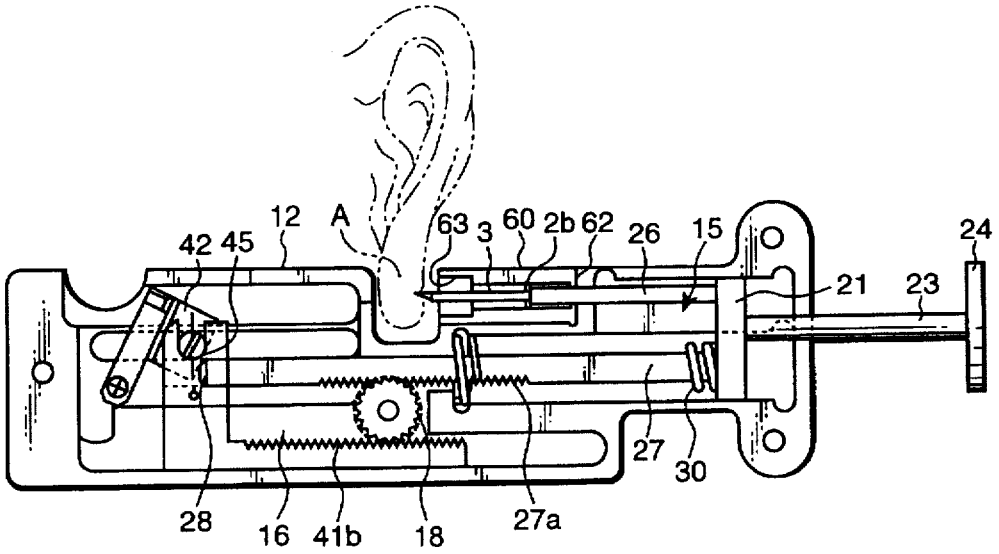
Figure 6:
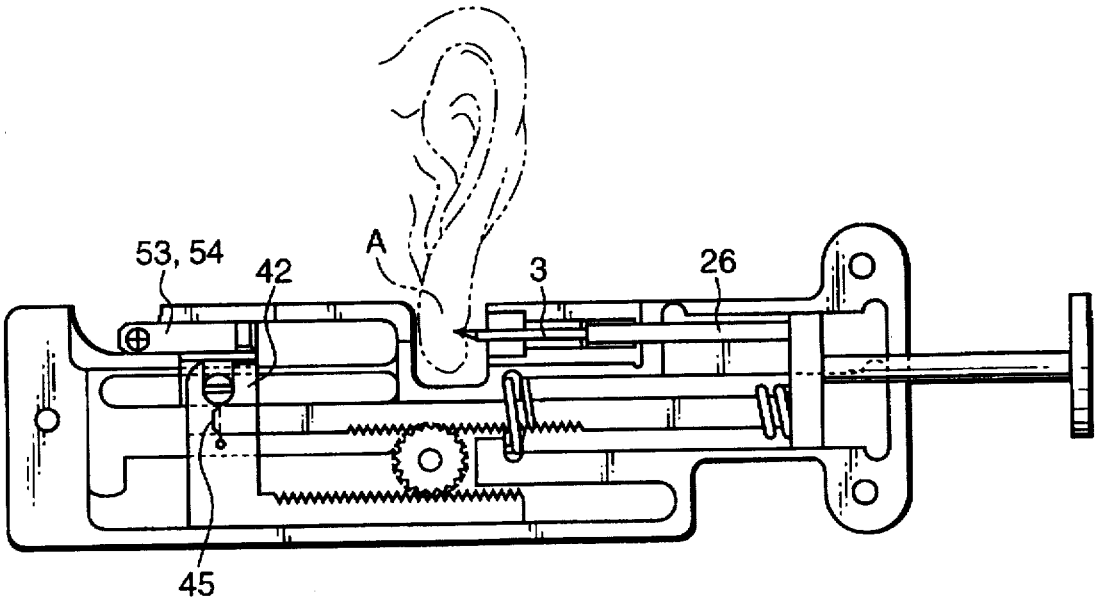

The support 42 and the first and second racks 27 and 41 are constructed so that the support 42 will be tamed upright, as shown in FIGS. 5 and 6, when the handle 24 is pushed and the front end 29 of the first rack 27 contacts the lower end of the support 42 between the beating plates 41*b* of the second rack 41. As shown in FIG. 2, the grasp mechanism 50 comprises a pair of cams 53 and 54 which are respectively rotatably supported by pivotal protrusions 51 and 52 formed on the upper surface of the support 42. The cams 53 and 54 are symmetrically arranged on both sides of the axis of the needle member 4 in the cartridge 60, when the support 42 rams upright as shown in FIG. 6. The cams 53 and 54 respectively have nip faces 55 and 56, at rear end thereof, for grasping the sharp tip of the needle member 4 therebetween, and a coil spring 57 is inserted between the front ends of the cams 53 and 54. The pivotal protrusions 51 and 52 respectively support the cams 53 and 54 at positions between the nip faces 55 and 56 and the spring 57; the spring 57 thereby urges the nip faces 55 and 56 to come close to each other with a constant force. A slight clearance is formed between the nip faces 55 and 56 to facilitate the insertion of the sharp tip of the needle member 4 between the nip faces 55 and 56.

As shown in FIG. 3, the cartridge 60 has a pair of grooves 62*a* at the rear end thereof for engaging with a pair of protrusions 13*a* of the cartridge mounting 13 of the body 11; the cartridge 60 can thereby be mounted in the mounting 13 in a detachable manner.

The cartridge 60 has a loading hole 63 for loading the needle member 4 and the hole maintenance rod 2 therein, and the loading hole 63 extends, along the center axis of the cartridge 60, from the rear face 62 to the front face 61 of the cartridge 60. This loading hole 63 consists of a rear portion 63*c*, a middle portion 63*b*, and a front portion 63*a*; and these three portions 63*a*, 63*b*, and 63*c* are formed coaxial with each other. The diameter of the rear portion 63*c* is slightly larger than that of the needle pusher 26 and is smaller than that of the flange 2*b* of the hole maintenance rod 2. The diameter of middle portion 63*b* is slightly larger than that of the flange 2*b*, and is smaller than that of the front portion 63*a*. Furthermore, the diameter of the front portion 63*a* corresponds to the diameter of a cylindrical needle guide 64 for coaxially supporting the needle member and the hole maintenance rod 2 in the loading hole 63.

The needle guide 64 consists of a pair of parts 64*a* having a gutter shape, and is preferably made from a relatively hard elastic material, for example, an elastomer or a plastic or the like. The needle guide 64 has an elliptic cross section having a major axis along the parting plane thereof, and the length of the major axis is slightly larger than the inner diameter of the front portion 63*a* of the loading hole 63. Furthermore, the rear face of the needle guide 64 is formed to be a concave conical shape which has a larger diameter than that of the flange 2*b* of the hole maintenance rod 2. The parts 64*a* of the guide 64 are attached on opposite sides of the circumference of the front end of the needle member 4, and the guide 64 is inserted into the front portion 63*a* of the loading hole 63 when the needle member 4 and the hole maintenance rod 2 are inserted into the loading hole 63. On the other hand, when the needle pusher 26 pushes the needle member 4 and the rod 2 out of the cartridge 60, the flange 2*b* of the rod 2 contacts the conical rear face of the needle guide 64, and the parts 64*a* will be automatically detached from the needle member 4.

Next, a hole making method using the above-described hole making device 10 will be explained.

Figure 7:
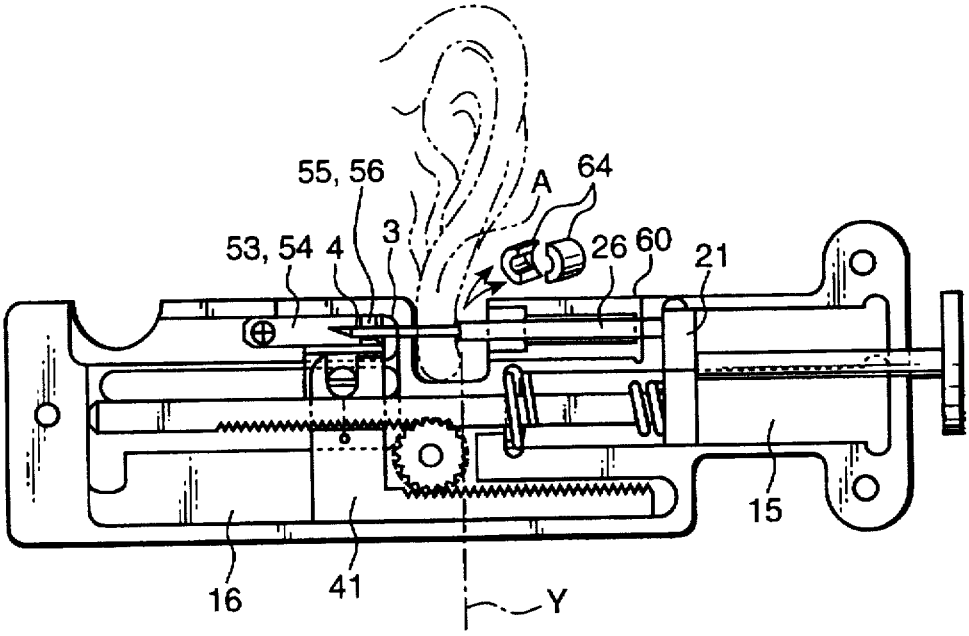

First, the needle member 4, in which the hole maintenance rod 2 is inserted, is loaded in the cartridge 60 together with the needle guide 64, and, as shown in FIG. 4, the cartridge 60 is mounted on the cartridge mounting 13. In this condition, by means of the elastic force of the coil spring 30, the first and second rack 27 and 41 are respectively placed at the rear end and the front end of the slidable ranges thereof. Therefore, the needle pusher 26 is drawn inside the body 11 so that it does not touch the needle member 4, the handle 24 is placed apart from the body 11, and the grasp mechanism 50 and the support 42 are turned forward Next, after an earlobe A, in which a hole is to be made, is inserted in the earlobe insertion recess 14, the handle 24 is pushed forward by an operator. The operator can easily handle this hole making device 10 in one hand because a pair of protrusions 11*a* are formed on the both upper and lower surfaces of the rear end of the body 11 for accommodating the fingers of the operator. As the handle 24 is pushed forward, the needle member 4 and the hole maintenance rod 2 are pushed forward by the needle pusher 26, and, as shown in FIG. 5, the needle member 4 contacts the earlobe A. At the same time, the front end of the first rack 27 pushes the lower end of the support 42, and the support 42 is mined upright, as shown in FIG. 6, against the force of the spring 45; the cams 53 and 54 are thereby mined horizontally to face the sharp tip of the needle member 4. By further pushing the handle 24, the needle member 4 comes out of the cartridge 60 and penetrates the earlobe A, and, as shown in FIG. 7, the flange 2*b* of the hole maintenance rod 2 butts the rear concave surface of the guide 64 to divide the guide 64 into two parts 64*a*. In the case where the guide 64 is made from an elastic material, the elastic force helps the division of the guide 64. The divided parts 64*a* immediately drops out from the needle member 4, and the flange 2*b* contacts the rear face of the earlobe A. The sharp tip of the needle member 4 is inserted between the nip faces 55 and 56 of the cams 53 and 54 of the grasp mechanism 50, widening the clearance between the nip faces 55 and 56 against the elastic force of the spring 57, and the needle member 4 is firmly grasped by the cams 53 and 54 which are urged by the spring 57.

Figure 8:
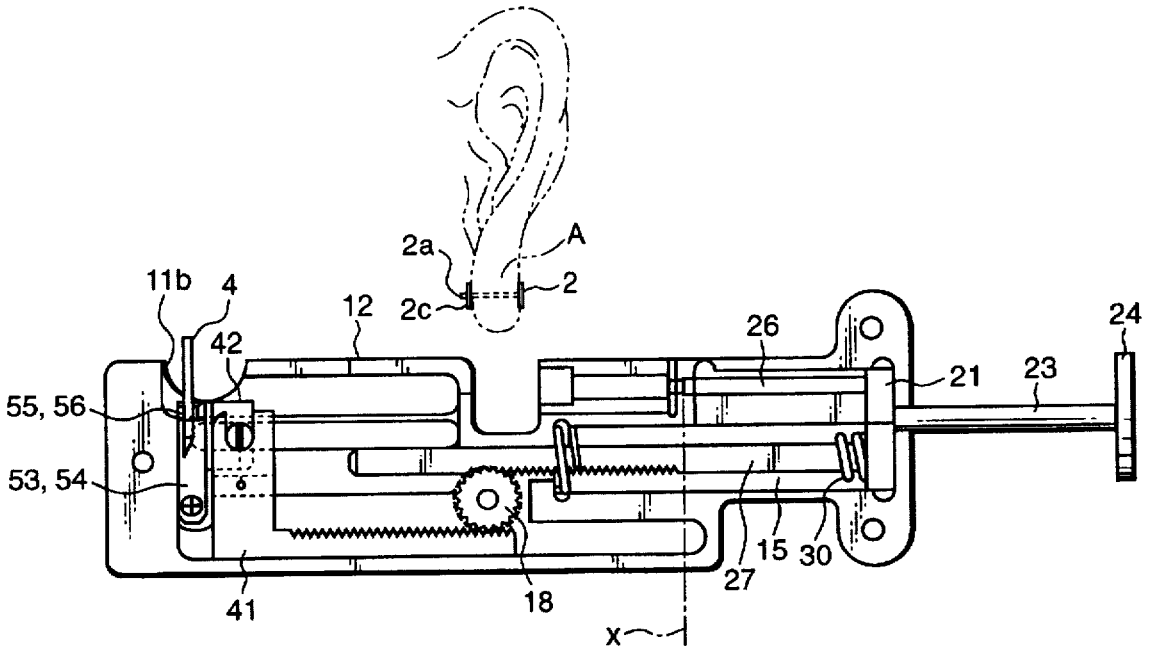

After the needle member 4 is grasped by the cams 53 and 54, by releasing the handle 24, the plate 21 is pressed back by the spring 30; thereby, the needle pusher 26, the handle 24, and the first rack 27 are shifted respectively to their initial positions, as shown in FIG. 8. Simultaneously, the second rack 41 is shifted forward, together with the grasp mechanism 50, by the rotation of the pinion 18, and the grasp mechanism 50 extracts the needle member 4 from the earlobe A, while leaving the hole maintenance rod 2 in the pierced hole in the earlobe A Furthermore, when the front end of the first rack 27 is pulled out from the support 42, the grasp mechanism 50 is turned forward as shown in FIG. 8, and the needle member 4 is turned upright through an opening 11*b* formed in the front end of the body 11. This pivotal movement of the grasp mechanism 50 facilitates picking up the used needle member 4 in a safe and sanitary manner. After releasing the earlobe A from the hole making device 10, a fastener 2*c* is affixed to the from end of the hole maintenance rod 2 to prevent the rod 2 from falling out of the earlobe A; thereby, the hole making operation is completed.

The hole making device 10 according to this embodiment comprises the piercing mechanism, the extraction mechanism, and the interlock mechanism for interlocking the piercing mechanism and the extraction mechanism. Therefore, it is possible, by only pushing the handle 24, to achieve both the piercing of the earlobe and the extracting of the needle member 4, in a smooth and continuous manner. Thus, this hole making device 10 can shorten the time which is necessary for the operation and reduce the pain of the person undergoing the operation, without requiring the operator to be highly skilled.

Furthermore, because the device 10 of the present embodiment employs the detachable cartridge 60 for loading the needle member 4 and the hole maintenance rod 2 at the initial position, it is easy to safely handle the needle member 4 and the rod 2, which are otherwise too small to be easily handled.

Additionally, in the device 10 of the present embodiment, the coil spring 30 always urges the needle pusher 26 and the grasp mechanism 50 in opposite directions. Therefore, after pushing the handle 24, it is possible, only by releasing the handle 24, to extract the needle member 4 and to restore the needle pusher 26 and the grasp mechanism 50 to their initial positions.

Furthermore, because this device 10 employs, as the interlock mechanism, a pair of the racks 27 and 41 and the pinion 18, it is possible to simplify and lighten the interlock mechanism.

Additionally, in the present device 10, after the hole making operation, the extracted needle member 4 is turned upright by the spring 45 while its sharp tip is held by the grasp mechanism 50. Therefore, it is possible to safely remove the needle member 4 which may be stained with blood.

Furthermore; in the present device 10, by inserting the sharp tip of the needle member 4 between the cams 53 and 54 of the grasp mechanism 50, the needle member 4 is grasped by the cams 53 and 54 biased by the spring 57. Therefore, it is possible to automatically anchor the needle member 4 penetrating the earlobe without requiring a complex actuating mechanism for grasping the needle member 4.

Additionally, because the needle member 4 is coaxially supported by the cylindrical needle guide 64 in the loading hole 63 of the cartridge 60, it is possible to accurately position the needle member 4. Therefore, the needle pusher 26 pushes the needle member 4 accurately along the axis of the needle pusher 26, and deviations in the penetrating direction of the needle member 4 can be prevented.

Furthermore, because the needle guide 64 can be divided into two parts 64*a* and has a conical rear end face to contact with the flange 2*b* of the rod 2, the needle guide 64 is automatically removed from the needle member 4 when the needle member 4 is stuck to the earlobe A. Therefore, the needle guide 64 does not impede the penetration of the needle member 4 through the earlobe A.

The hole making device of the present invention is not limited to application to the earlobe; this device can be applied to other objects, for example, other parts of the human body or to parts of animals.

In addition, the hole making device of the present invention can be modified as desired within the scope of the present invention. For example, the needle pusher 26 can be directly fixed to the first rack 27, instead of being fixed to the plate 21. The springs 30, 45, and 57 can be replaced by bias means other than metal springs, for example, a rubber material or an elastomer. In place of the needle member 4 having a tubular shape, for example, a needle member having a C-shape section can be employed.

Furthermore, in place of the interlock mechanism using rack and pinion, other types of interlock mechanisms, for example, a mechanism using a timing belt, electrical actuators or the like, can be employed.

Second Embodiment

Next, referring to FIGS. 9 to 17, the second embodiment of the present invention will be explained. In FIGS. 9–17, reference numerals which are identical to those of FIGS. 1–8, respectively, indicate elements which are identical to those of the first embodiment; therefore, explanation thereof will be omitted.

Figure 9:
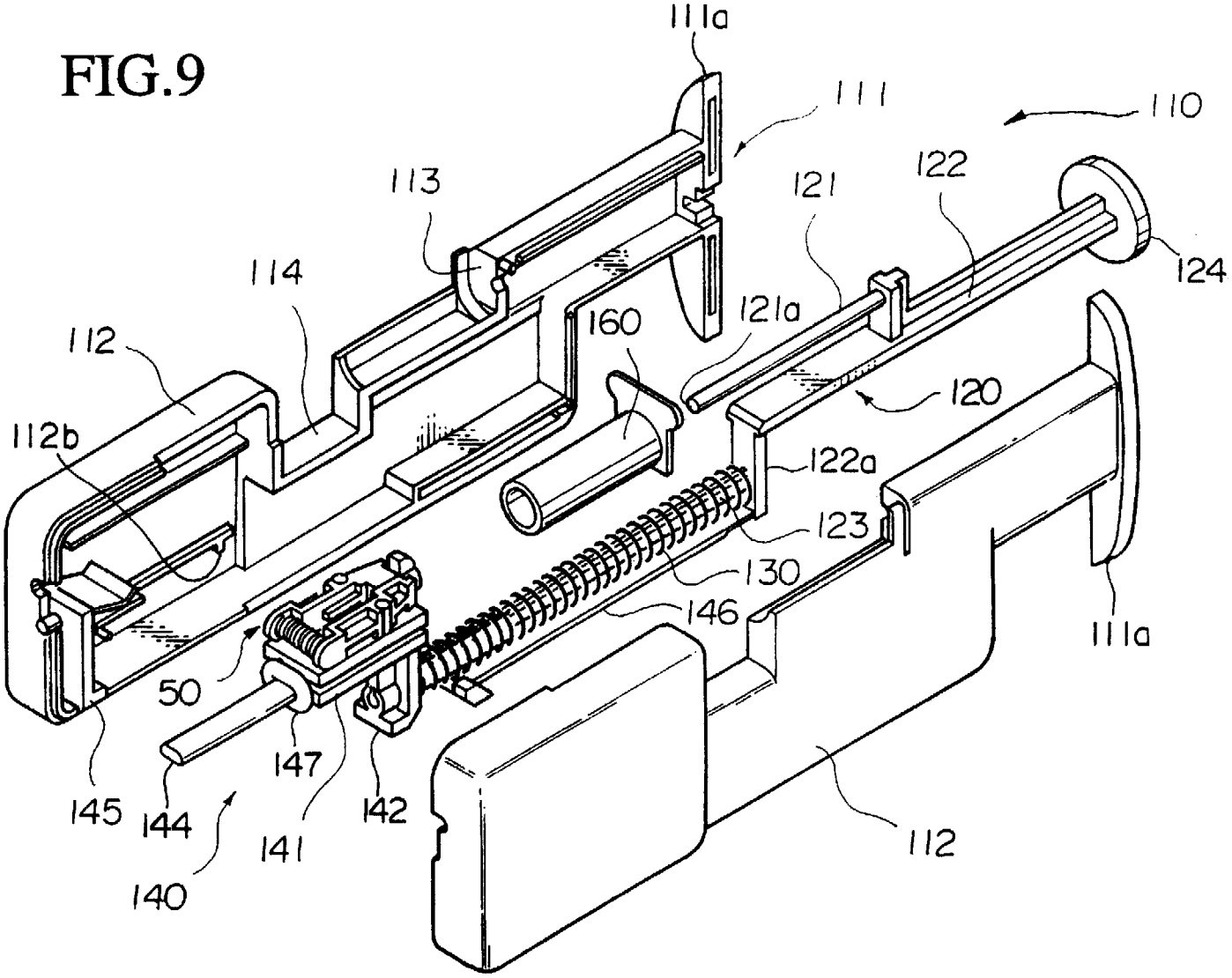
FIG. 9 is an exploded view of a hole making device according to the second embodiment of the present invention.

As shown in FIG. 9, the hole making device 110 of the second embodiment comprises a piercing mechanism 120 for passing a needle member 4 through an earlobe, an extraction mechanism 140 for receiving the needle member 4 penetrating the earlobe and extracting the needle member 4 through the earlobe, and an interlock mechanism 123, 130, 144, 145 and 146 for interlocking the piercing mechanism 120 and the extraction mechanism 140. The piercing mechanism 120, the extraction mechanism 140, and the interlock mechanism are all accommodated in a body 111 having a substantially rectangular shape. The body 111 is constructed by a pair of casings 112 in a separatable manner, and a cartridge mounting 113 and an earlobe insertion recess 114 are formed adjacent to each other in the middle of the upper side of the body 111. Furthermore, the body 111 has a flange portion 111*a* on the rear end thereof for hooking the fingers of the operator. A cylindrical cartridge 160, for loading the needle member 4 and the hole maintenance rod 2, is detachably mounted in the cartridge mounting 113. This cartridge 160 has a loading hole 63 and a rear plate 162 which engages with the cartridge mounting 113.

The piercing mechanism 120 comprises a slide rod 122 provided in the body 111 in a slidable manner in a longitudinal direction of the body 111. The rear end of the slide rod 122 protrudes out of the body 111, and a handle 124 is formed thereon. The slide rod 122 has a front plate 122*a* protruding downward from the front end of the slide rod 122, and a slide shaft 123 and a stopper release plate 146 are affixed to the front plate 122*a* in a manner parallel with the slide rod 122. Furthermore, a needle pusher 121 having a rod shape is fixed to the middle portion of the slide rod 122 in a parallel manner, and the needle pusher 121 is constructed to protrude its tip 12 1 a through the cartridge mounting 113 when the handle 124 is pushed forward. A coil spring 130 is passed along the slide shaft 123, and the coil spring 130 is compressed between the front plate 122*a* and a support 141 engaged with the front end of the slide shaft 123. The spring 130 biases both the plate 21 and the support 141 in opposite directions, thereby drawing back the needle pusher 12 1 from the cartridge mounting 113.

Figure 10:
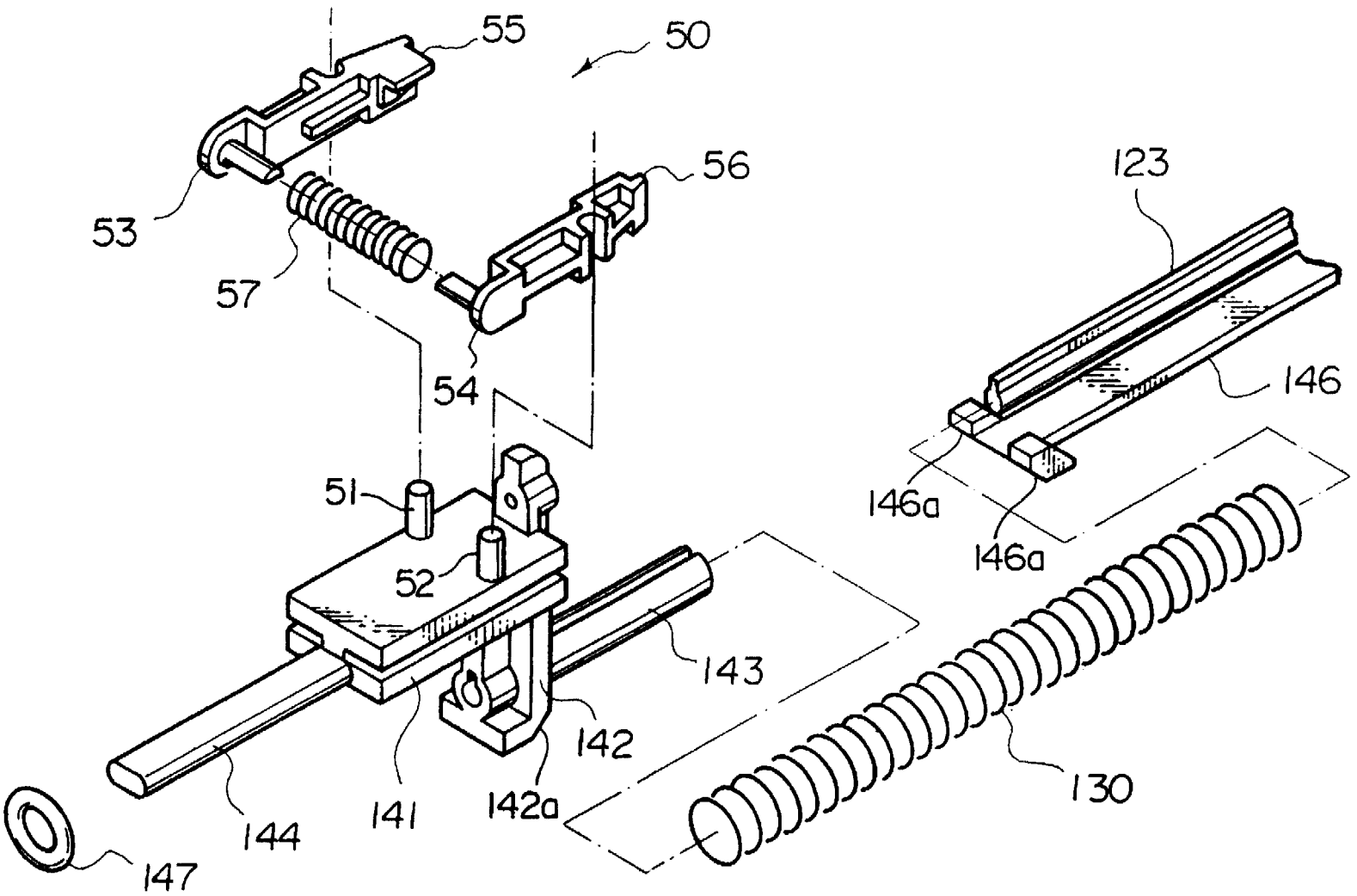
FIG. 10 is a perspective view of a grasp mechanism and an interlock mechanism of the second embodiment.

The extraction mechanism 140 comprises a grasp mechanism 50 which is substantially identical with that of the first embodiment, and the support 141 for supporting the grasp mechanism 50. As shown in FIG. 10, the support 141 has a slide pipe 143 connected to the rear end thereof through a rear plate 142, and a push-back bar 144 extended forward from the front end thereof. The front end of the slide shaft 123 is coaxially inserted into the slide pipe 143 in a slidable manner, and the front end of the spring 130 contacts with the rear plate 142. The slide pipe 143 has a key groove engaged with a key projection formed on the circumference of the slide shaft 123; relative rotation between the slide pipe 143 and the slide shaft is thereby prevented. The center hole of the pipe 143 penetrates the rear plate 142 to allow the sliding of the slide shaft 123 over a wide range.

Figure 11:
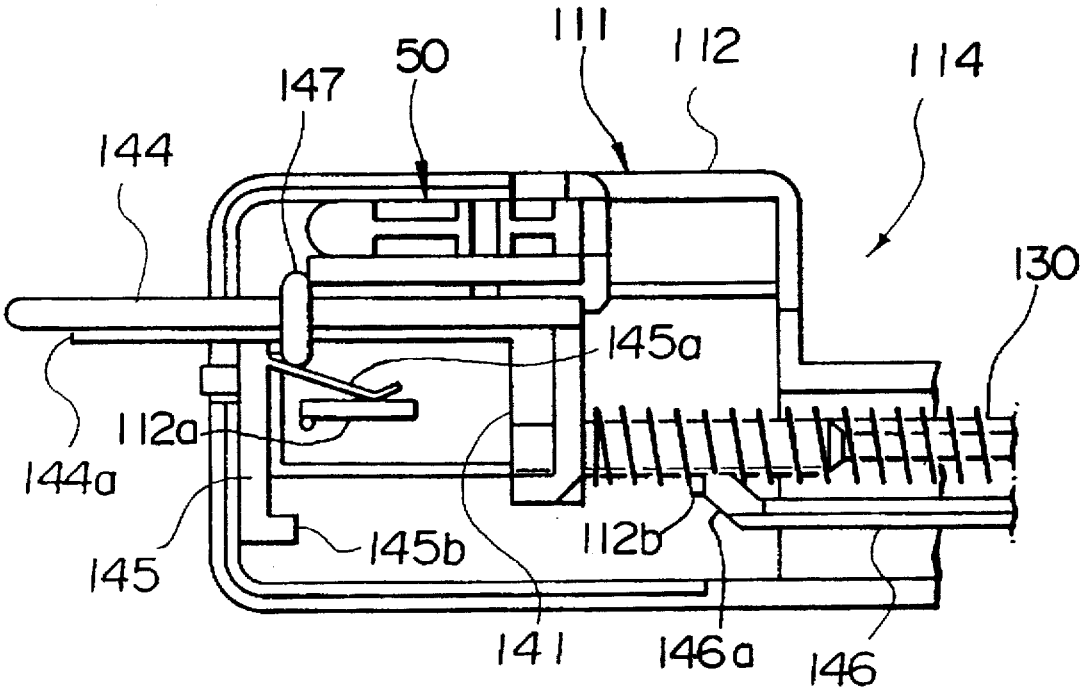
FIG. 11 is a side view of the grasp mechanism and the interlock mechanism of the second embodiment.

The push-back bar 144 penetrates the front wall of the body 111, and it can protrude forward when the support 141 is shifted to the front end position of its slidable range as shown in FIG. 11. A cushion ring 147 made from an elastic material is passed through the push-back bar 144 so as to absorb a shock when the support 141 is quickly shifted forward by the spring 130.

A stopper 145 is provided in the front of the support 141 for locking the support 141 at a rear end position of the slidable range thereof against the force generated by the spring 130. The stopper 145 is arranged in a slidable manner up and down along the inner surface of the front end wall of the body. The stopper 145 has a spring portion 145*a* extended rearward from the rear face thereof, and the spring portion 145*a* is supported by a protrusion 112*a* fixed in the body 111; the stopper 145 is thereby urged towards the push-back bar 144 by an elastic force of the spring portion 145*a*. An elongated protrusion 144*a* is formed along the lower surface of the push-back bar 144, and the front end of the protrusion 144*a* is formed so as to engage with the upper end of the stopper 145 when the support 141 is shifted to its rear end position; the stopper 145 thereby prevents the support 141 from shifting forward.

Furthermore, the stopper 145 has a hook portion 145*b* projecting rearward from the lower end thereof, and the hook portion 145*b* is constructed to be pushed down by the front end of the stopper release plate 146 when the stopper release plate 146 is shifted to the front end position of the slidable range thereof. The stopper release plate 146 has a pair of inclined faces 146*a* at the front end thereof, thereby facilitating the pushing down of the hook portion 145*b* of the stopper 145.

Figure 12:
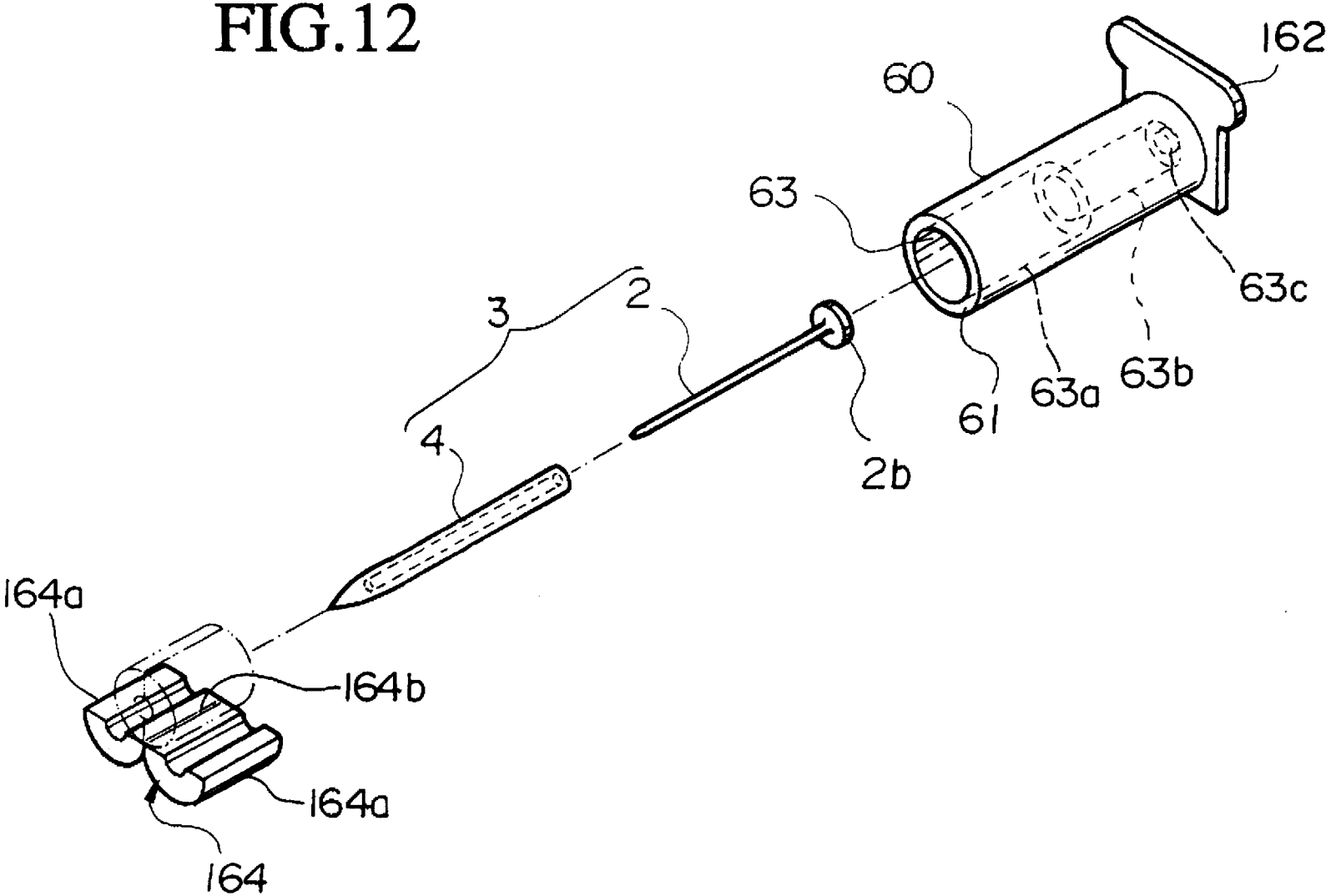
FIG. 12 is a perspective view of a cartridge, a needle member, a hole maintenance rod, and a needle guide, of the second embodiment.

In this embodiment, the sharp tip of the needle member 4 is formed to have a conical shape, as shown in FIG. 12, in place of the diagonally cut shape of that of the first embodiment. Therefore, the front end of this needle member 4 is completely closed.

In addition, in this embodiment, a needle guide 164 which is different from that of the first embodiment is employed. This needle guide 164 is constructed by a pair of gutter-shape portions 164*a* which are integrally connected by a hinge 164*b* which is preferably formed by an elastic material or a plastic. More preferably, the hinge 164*b* is formed so as to urge the portions 164*a* to open as shown in FIG. 12. According to the needle guide 164, when an operator inserts the needle guide 164 together with the needle member 4 into the cartridge 160, the operator can easily put the very small portions 164*a* together on the needle member 4; therefore, it is possible to improve the ease of handling of the needle guide 164.

Figure 13:
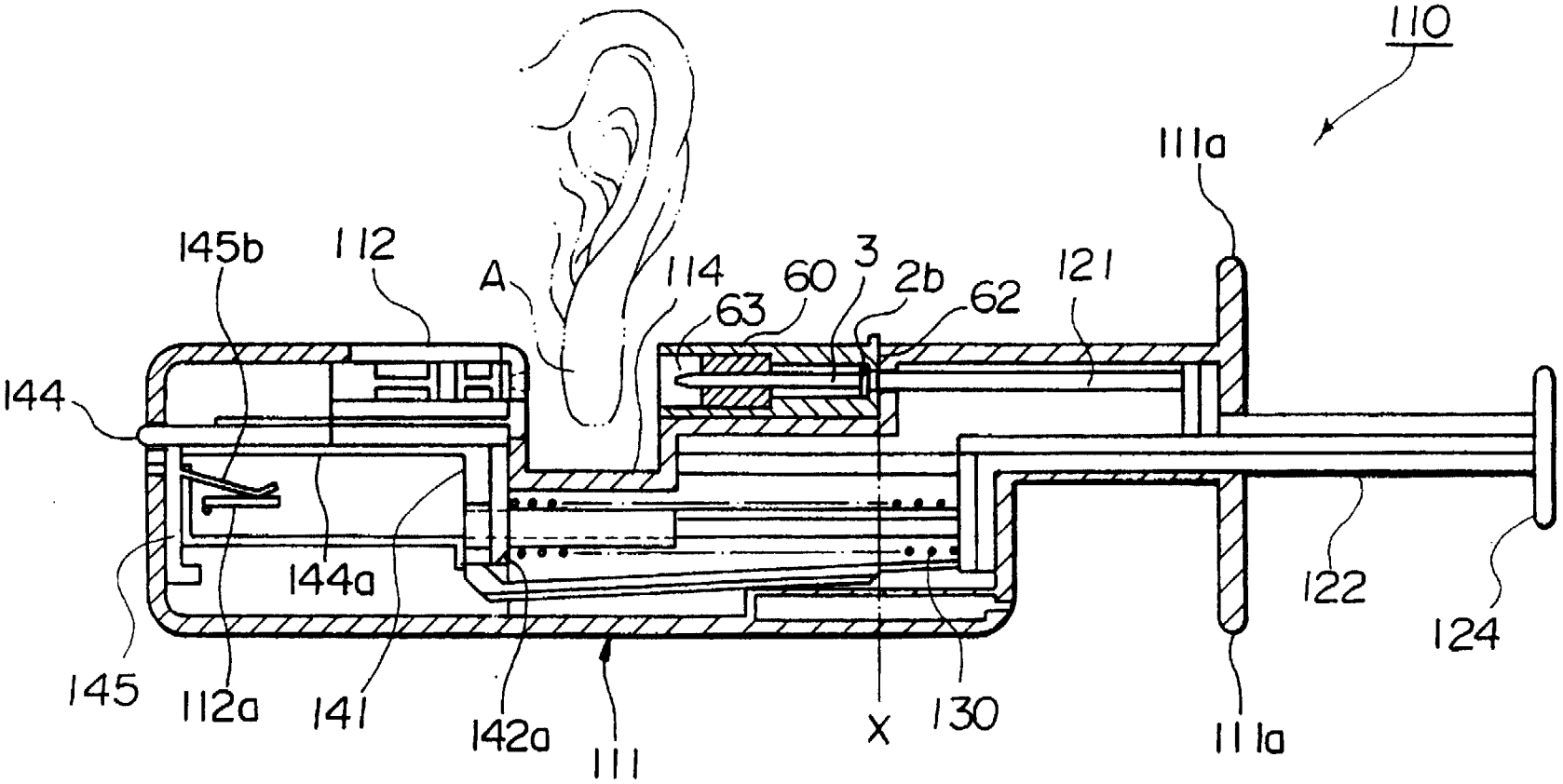
FIGS. 13–17 are respectively cross sections of the second embodiment explaining the action of the device during the hole making operation.

The use of the above-described hole making device 110 will be explained. First, the cartridge 160, in which the needle member 4, the rod 2, and the needle guide 164 are inserted in advance, is mounted on the cartridge mounting 113 as shown in FIG. 13. In this condition, the plate 122 are located at the rear end position in the slidable range thereof by the force of the coil spring 130; the needle pusher 121 is thereby dram back from the cartridge mounting 113. On the other hand, the push-back bar 144 is pushed inside the body 111 against the coil spring 130; the support 141 is thereby located at the rear end position in the slidable range thereof, and the stopper 145, which is urged upward by the spring portion 145*b*, engages with the front end of the protrusion 144*a* to prevent the support 141 from shifting forward.

Figure 14:
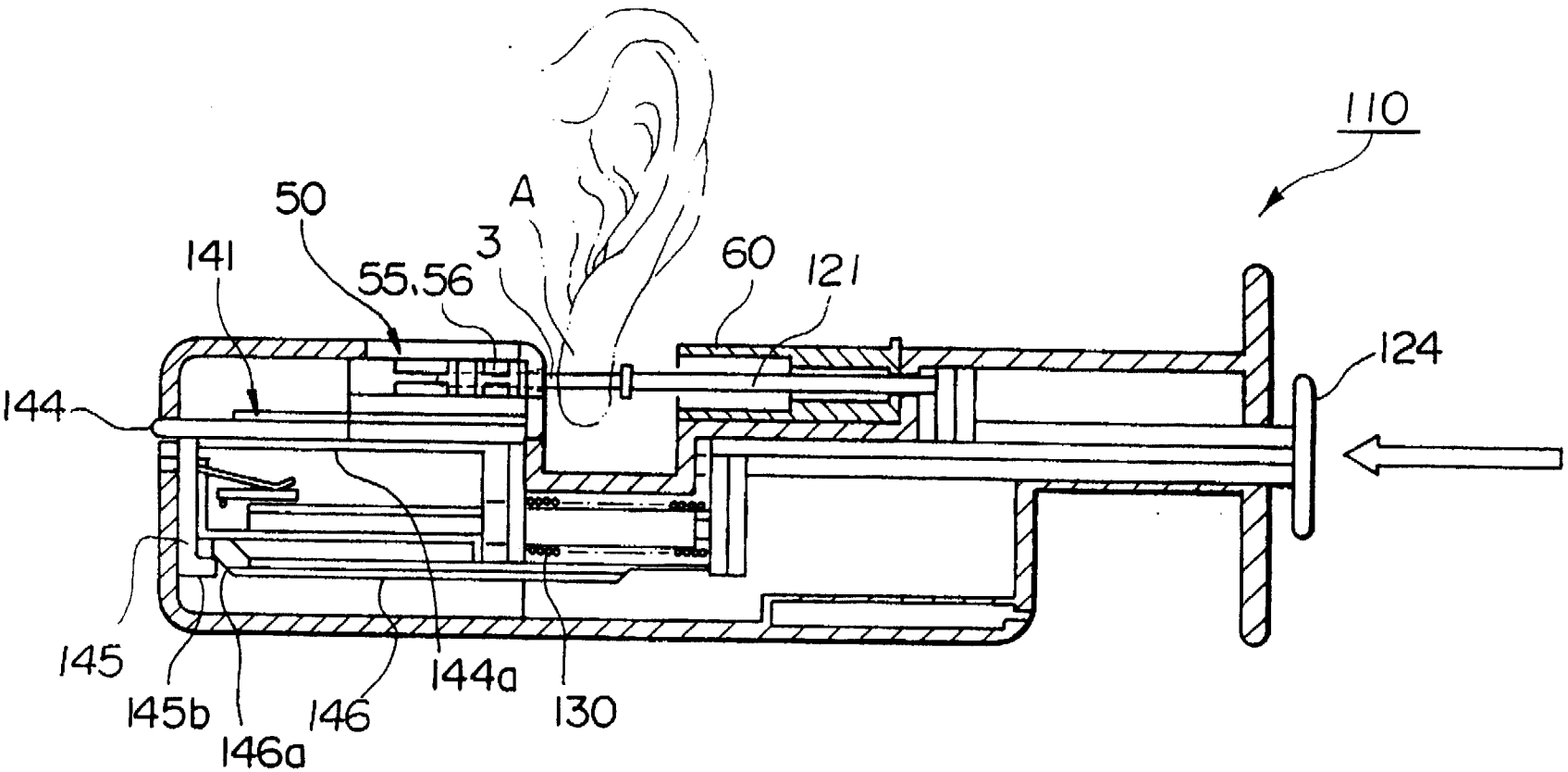
Figure 15:
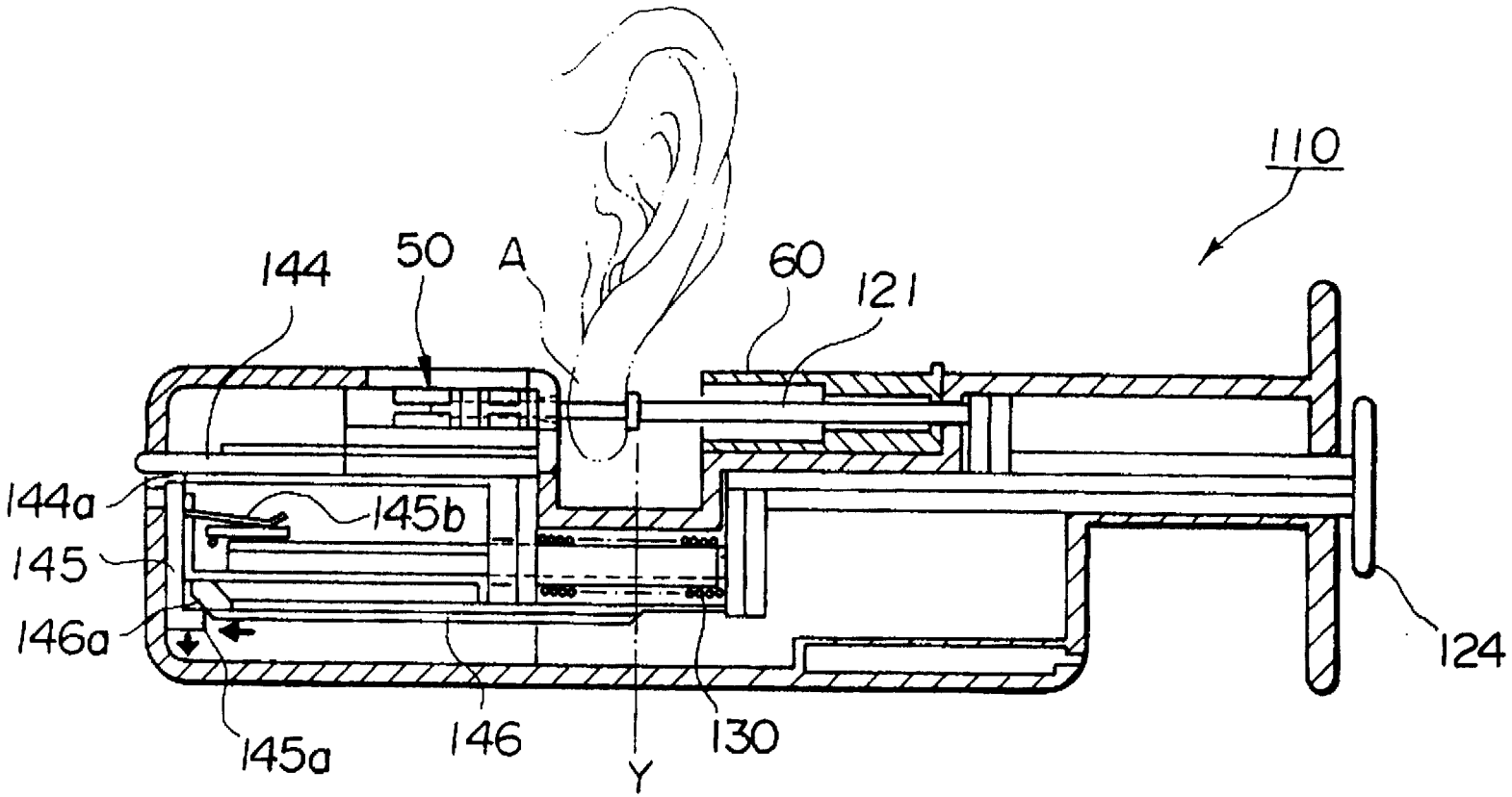
Figure 16:
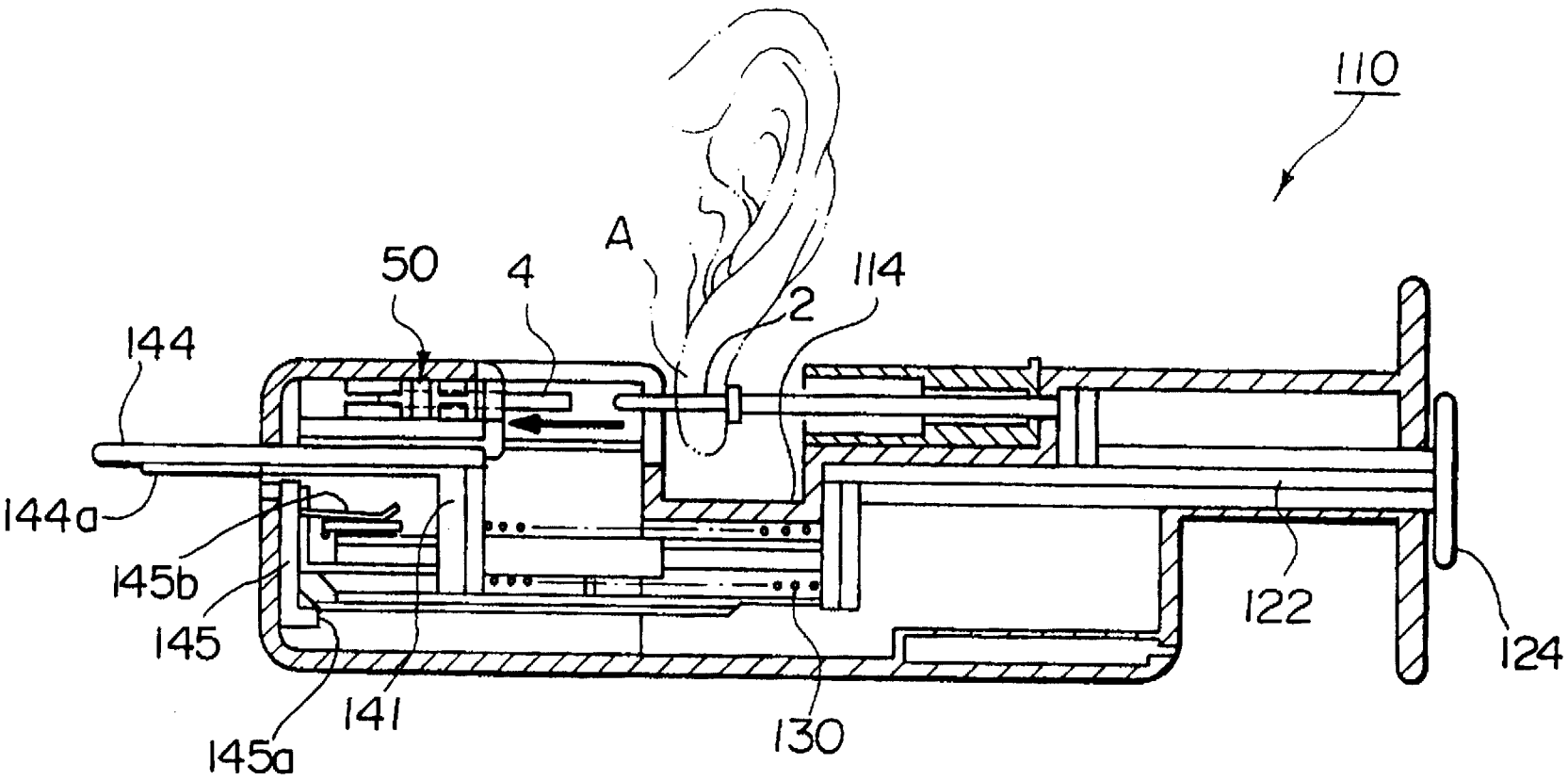
Figure 17:
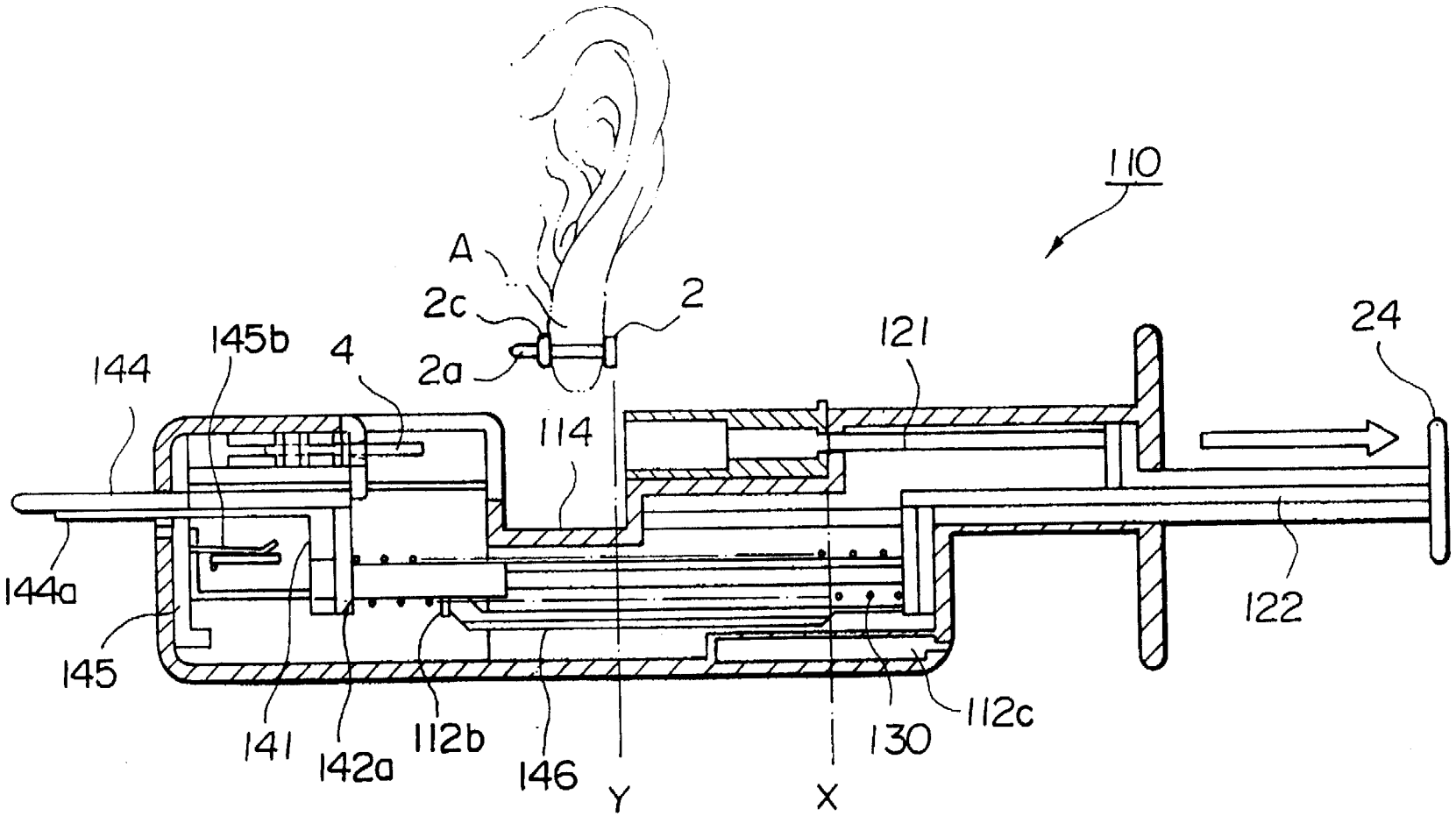

Next, after an earlobe A is inserted in the earlobe insertion recess 114, the handle 124 is pushed forward by an operator. The operator can easily handle this hole making device 110 in one hand because a flange 11 la is formed on the rear end of the body 111 for accommodating the fingers of the operator. As the handle 124 is pushed forward, the needle member 4 and the hole maintenance rod 2 are pushed forward by the needle pusher 121, and the needle member 4 finally penetrates the earlobe A, as shown in FIG. 13, and is firmly grasped by the grasp mechanism 50. At the same time, as shown in FIGS. 14 and 15, the inclined faces 146*a* of the stopper release plate 146 push down the hook portion 145*b* of the stopper 145, and the engagement of the stopper 145 and the protrusion 144*a* is released. The support 141 is thereby quickly shifted forward by the force of the spring 130, and as shown in FIG. 16, the grasp mechanism 50 extracts the needle member through the earlobe A while leaving the hole maintenance rod 2 in the earlobe A. After releasing the earlobe A from the hole making device 110, a fastener 2*c* is affixed to the front end of the hole maintenance rod 2 as shown in FIG. 17. The slide rod 122 is pushed back by the spring 130 to the initial position thereof when the handle 124 is released.

After the support 141 is shifted forward as shown in FIG. 17, the front end of the stopper release plate 146 engages with a pair of protrusions 112*b* formed on the inner surface of the body 111 (see also FIG. 9); it thereby becomes impossible to push the handle 124 forward. Thus, after the hole making operation is completed, careless pushing of the handle 124 can be prevented. The engagement of the stopper release plate 146 and the protrusion 112*b* can be released by pushing the push-back bar 144 into the body 111. That is, when the support 141 is shifted to the rear end in the slidable range thereof, as shown in FIG. 13, a pair of inclined face 142*a* formed at the lower end of the support 141 push down the front end of the stopper release plate 146 to detach from the protrusion 112*b*, thereby permitting the advance of the plate 146.

In order to return the hole making device 110 to the original condition, the push-back bar 144 is pushed into the body 111 as described above. The stopper 145 is thereby pushed upward by the spring 145*b* to engage the front end of the protrusion 144*a* of the push-back bar 144, and the used needle member 4, which is held by the grasp mechanism 50, appears in the earlobe insertion recess 114. Therefore, it is easy to pick up the needle member 4 from the grasp mechanism 50. The used needle member 4 can be safely disposed in a disposal room 112*c* (see FIG. 17) formed inside the body 111.

According to the hole making device of the second embodiment, as soon as the operator has finished pushing the handle 124 to stick the needle member 4 through the earlobe A, the interlock mechanism 130, 141, 145, and 146 automatically shifts the grasp mechanism 50 to extract the needle member 4 from the earlobe A, whether the handle 124 is released or not. Therefore, it is possible to perform both the piercing and the extraction of the needle member 4 more smoothly.

Furthermore, because the device of the present embodiment consists of parts of lesser number than those of the first embodiment, it is possible to manufacture this device with lower cost than the first embodiment, and to use this device in a disposable manner after each use.

Figure 18:
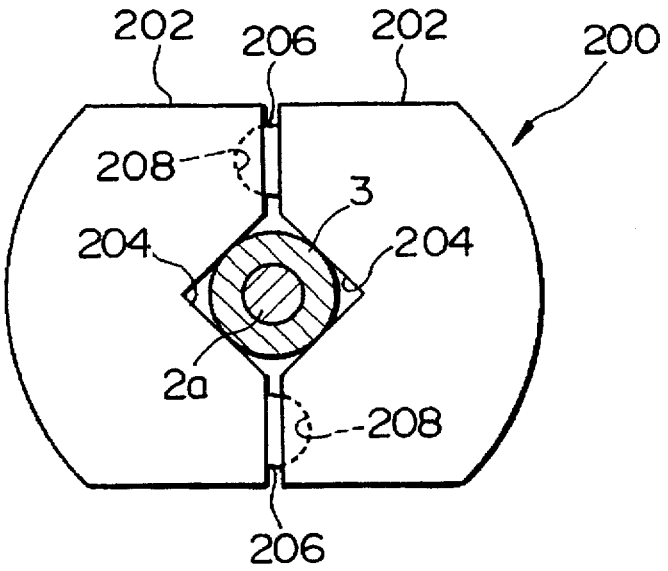
FIG. 18 is a front view of a needle guide of the second embodiment.
Figure 19:
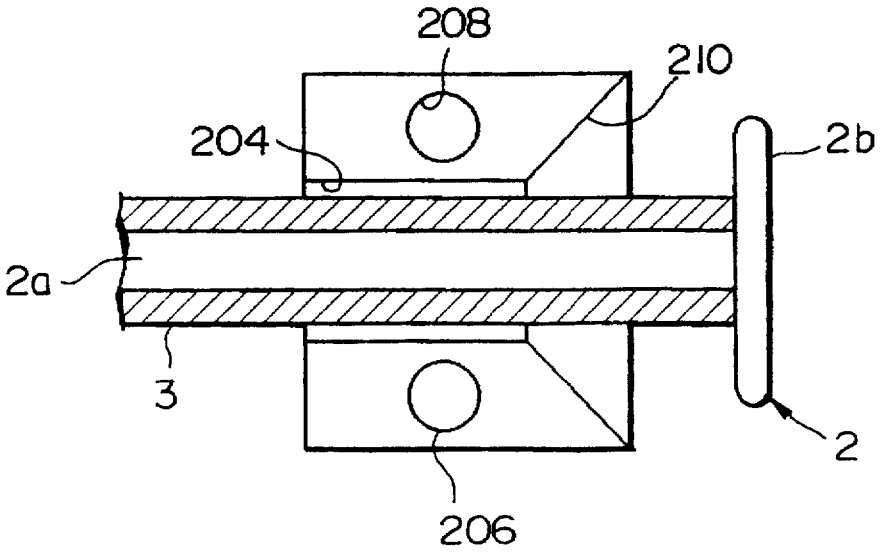
FIG. 19 is a cross section of a needle guide of the second embodiment.

In place of the above-described needle guides 64 and 164, a needle guide 200 shown in FIG. 18 and 19 can also be employed. This needle guide 200 consists of a pair of gutter-shaped parts 202 which are separatably put together to form a cylindrical shape, and the parts 202 respectively have a center groove 204 having a V-shaped section. Preferably, the sectional angle of the groove 204 is about 90 °. By forming the center groove 204 to have a V-shaped section, it is possible to decrease the contact area of the needle guide 200 and the needle member 4 and to decrease the frictional force between them. Therefore, when the needle member 4 and the rod 2 are pushed out from the cartridge, it is possible to decrease the risk that the needle guide 200 will fall out of the cartridge before the flange 2*b* of the rod 2 pushes the guide 200, thereby producing the deviations in the penetrating direction of the needle member 4.

The rear face of the guide 200 is preferably formed to be a concave conical shape, so that the parts 202 can be divided by the flange 2*b* of the hole maintenance rod 2 when the flange 2*b* contacts the rear face of the guide 200. On the contact face of each part 202, a hemispheric protrusion 206 and a hemispheric recess 208 are formed so that the protrusion 206 of one of the parts 202 engages with the recess 208 of the other parts 202 when attached on the needle member 4. By forming such engaging means 206 and 208 on the contact faces of the parts 204, it is possible to improve the easiness of the handling of the needle guide 200 when setting the needle member 4 and rod 2 in the cartridge.

What is claimed is:

1. Hole making device comprising:

a hole maintenance member having a rod portion;

a needle having a pointed tip and a recess therethrough for accommodating said rod portion of said hole maintenance member;

a piercing mechanism for passing said needle member accommodating said rod portion of said hole maintenance member through an object in which a hole is to be made;

an extraction mechanism for receiving said needle member after penetrating said object and extracting said needle member from said object in a a direction in which said pointed tip of said needle member points so as to leave said hole maintenance member in said object; and an interlock mechanism for interlocking said piercing mechanism and said extraction mechanism.

2. The hole making device according to claim 1, further comprising:

a body for accommodating said piercing mechanism, said extraction mechanism, and said interlocking mechanism;

a cartridge for detachably supporting said needle member in which said hole maintenance member is inserted; and a cartridge mounting provided on said body for detachably mounting said cartridge so that said tip of said needle member supported by said cartridge is directed toward said extraction mechanism and so that the end opposite to said tip is directed toward said piercing mechanism.

3. The hole making device according to claim 2, wherein said cartridge has a loading hole for detachably loading said needle member accommodating said rod portion of said hole maintenance member, and a guide detachably attached on said needle member for supporting said needle member in said loading hole.

4. The hole making device according to claim 3, wherein said guide consists of a pair of gutter-shaped parts which are separatably put together to form a cylindrical shape, and the gutter-shaped parts have engage means for engaging with each other.

5. The hole making device according to claim 3, wherein said guide consists of a pair of gutter-shaped parts separably joined to form a cylindrical shape, the gutter-shaped parts having at least one of a protrusion and a recess for engaging with each other in a detachable manner.

6. The hole making device according to claim 3, said guide consisting of a pair of gutter-shaped parts separably joined to form a cylindrical shape, each of the gutter-shaped parts having a center groove having a V-shaped cross section for supporting the outer periphery of said needle member.

7. The hole making device according to claim 3, said hole maintenance member having a flange formed at the rear end of said rod portion, said guide consisting of a pair of gutter-shaped parts separably joined to form a cylindrical shape, each of the gutter-shaped parts having a rear face formed to be concavely conical so as to be separable from each other when said flange of said hole maintenance member pushes said rear faces of said parts.

8. The hole making device according to claim 1, wherein said piercing mechanism comprises a needle pusher being movable along an axis of said needle member, and said interlock mechanism comprises a bias means for biasing said needle pusher in a direction opposite to a direction in which said needle member is pushed.

9. The hole making device according to claim 1, wherein said extraction mechanism comprises a grasp mechanism for grasping said tip of said needle member when said tip of said needle member is inserted thereinto, and a shifting mechanism for shifting said grasp mechanism along an axis of said needle member.

10. The hole making device according to claim 9, wherein said shifting mechanism comprises a bias means for urging said grasp mechanism in a direction towards which said needle member is extracted, a stopper for locking said grasp mechanism at a position in which said grasp mechanism is shifted towards said needle member against the force generated by said bias means, and an unlock mechanism connected to said piercing mechanism for unlocking said stopper when said piercing mechanism inserts said needle member into said object.

11. The hole making device according to claim 9, wherein said grasp mechanism comprises a pair of cams for grasping said tip of said needle member therebetween, and a bias means for urging said cams towards each other.

12. The hole making device according to claim 1, wherein said interlock mechanism comprises a first rack for shifting said piercing mechanism, a second rack arranged in parallel with said first rack for shifting said extraction mechanism, and a pinion engaging with both said first and second racks.

13. The hole making device according to claim 1, wherein said piercing mechanism comprises a needle pusher being movable along an axis of said needle member;

said extraction mechanism comprises a grasp mechanism for grasping said tip of said needle member when said tip of said needle member is inserted thereinto; and said interlock mechanism comprises a biasing means for urging both said needle pusher and said grasp mechanism in opposite directions to each other, a stopper for locking said grasp mechanism at a position in which said grasp mechanism is shifted towards said needle pusher, and an unlock mechanism connected to said needle pusher for unlocking said stopper when said needle pusher inserts said needle member into said object.

14. The hole making device according to claim 1, wherein said extraction mechanism comprises a grasp mechanism for grasping said tip of said needle member when said tip of said needle member is inserted thereinto, a support supporting said grasp mechanism rotatably around an axis perpendicular to an axis of said needle member, a shifting mechanism for shifting said support between a first position in which said grasp mechanism is located close to said piercing mechanism and a second position in which said grasp mechanism is located apart from said piercing mechanism, and a pivoting mechanism for pivoting said support so that said grasp mechanism faces towards said needle member when said support is shifted to said first position so that said grasp mechanism faces towards a direction intersecting a direction of shifting said support when said support is shifted to said second position.

* * * * *